United States Patent [19]

Davenport

[11] Patent Number: 5,020,166

[45] Date of Patent: Jun. 4, 1991

[54] MULTI-PURPOSE WATER PRESSURE PLUNGER

[76] Inventor: Clyde F. Davenport, 405 Oakwood St., Greenwood, S.C. 29646

[21] Appl. No.: 498,287

[22] Filed: Mar. 23, 1990

[51] Int. Cl.[5] ..... E03D 11/00

[52] U.S. Cl. ..... 4/255; 4/256; 4/257

[58] Field of Search ..... 4/255–257, 4/661

[56] References Cited

U.S. PATENT DOCUMENTS

| | | | |
|---|---|---|---|
| 1,941,065 | 12/1933 | Williamson | 4/255 |
| 2,312,826 | 3/1943 | Leyden | 4/256 |
| 2,500,404 | 3/1950 | Donnelly | 4/256 |
| 2,535,092 | 12/1950 | Rettinger | 4/256 |
| 3,537,113 | 11/1970 | Elzner | 4/256 |
| 3,672,380 | 6/1972 | Schuster | 4/256 |
| 4,238,860 | 12/1980 | Dixon | 4/256 |
| 4,320,539 | 3/1982 | Li | 4/255 |
| 4,768,237 | 9/1988 | Tonti | 4/256 |

*Primary Examiner*—Henery K. Artis
*Attorney, Agent, or Firm*—Bailey & Hardaway

[57] ABSTRACT

A multi-purpose water pressure plunger employs a source of pressurized water to dislodge clogs in bathroom drainage pipes and the like. The plunger is fashioned of a resilient cone-shaped cup, a rigid handle, an adjustable valve, and a means of connection to a pressurized source of water. Sealing against and partially extending into a drain opening, the cup permits full thrust of pressurized water into a drainage pipe without a backflow of water. The cup consists of an upper, deformable portion, and a solid, occlusive bottom portion defining a nipple-shaped end. A flow of pressurized water is supplied to the cup through an elongated and ridged handle with a lengthwise aperture therethrough. An adjustable valve including a ball component and a regulating lever controls the flow of water into the handle, and thus, to the clogged drain.

For oddly-shaped and rounded drainage openings, the multi-purpose water pressure plunger has a sealing attachement including a compressible cup having a barrel-like bottom and an occlusive semi-spherical disc. When inserted, the barrel-like bottom partially extends into a drainage opening, and when pressed downwardly, the semi-spherical disc seals the barrel-like bottom against walls of a drainage opening, and the perimeter of the compressible cup envelopes around the barrel-like bottom.

6 Claims, 2 Drawing Sheets

MULTI-PURPOSE WATER PRESSURE PLUNGER

BACKGROUND OF THE INVENTION

This invention relates generally to the art of drain clearing devices, and more particularly, to drain clearing devices which utilize pressurized water to eliminate drainage obstructions which occur in bathroom pipes and the like.

The art of unclogging drainage pipes is well known and has conventionally employed manually-operated devices of the type comprising a resiliently collapsible, rounded cup having an open interior cavity. Attached to the cup is an elongated handle element extending from the end thereof opposite the open interior cavity. The cup is placed over a drainage entrance, and by applying a downward and upward force to the handle, the cup is alternately compressed and expanded. The suction caused by this motion is generally effective in loosening small drainage clogs, however, larger obstructions may not be budged by such manual devices. One such device is disclosed in U.S. Pat. No. 4,622,702 to Allen wherein a manually operated plunger includes a collapsible cup for covering and sealing around a drain opening.

U.S. Pat. No. 4,674,137 to Girse discloses an electrically operated cup attached to a manually operated pumping member.

The art of clearing drainage pipes has also employed pressurized water for forcing a clog from its lodged position into the sewer system. These pressurized devices are of the type comprising a resilient drain sealing member of differing shapes and sizes. An elongated handle, having a lengthwise passage therethrough, communicates with the sealing member and extends from the end thereof opposite the sealing member. A flow of pressurized water passes into and through the handle consequently entering the drain which is proportionately embraced by the sealing member.

One such device is disclosed in U.S. Pat. No. 3,537,113 to Elzner wherein a collapsible cup of the conventional type covers and seals around the opening of a drain. A flow of pressurized water, controlled by a faucet-type valve, passes through the handle and into the drain.

U.S. Pat. No. 4,768,237 to Torti discloses a tubular handle element attached to a mushroom-shaped cup having a check valve to prevent a backflow of water. A female means on the opposite end of the handle allows the connection to a pressurized source of water.

U.S. Pat. No. 4,320,539 to Li discloses an elongated pipe with a manually operated plunger valve which activates a flow of pressurized water. A side arm, branching from and communicating with the pipe, is attached to a source of pressurized water by a male means of connection.

While the above prior art devices may perform satisfactorily in many instances, they are often incapable of providing a sanitary and efficient means of unclogging bathroom drains and the like. In particular, the drain clearing devices of the prior art are not constructed to allow for a secure enough seal of a drain opening, they do not permit the correct thrust of pressurized water to a clog, and they do not afford themselves to easy operation by the ultimate consumer.

SUMMARY OF THE INVENTION

It is therefore an object of this invention to provide a multi-purpose water pressure plunger of the type transcending the encumbrances of the prior art.

It is a further object of this invention to provide a multi-purpose water pressure plunger which is safe and easy to use and which connects to any standard source of pressurized water.

It is a still further object of this invention to provide a multi-purpose water pressure plunger which completely seals a drain opening and which generates a direct impact of pressurized water to a drainage clog.

It is a still further object of this invention to provide a multi-purpose water pressure plunger which seals for oddly-shaped and rounded drainage openings.

These, as well as other objects, are accomplished by a multi-purpose water pressure plunger employing a source of pressurized water to dislodge clogs in bathroom drainage pipes and the like. The plunger is fashioned of a resilient cone-shaped cup, a rigid handle, an adjustable valve, and a means of connection to a pressurized source of water. Sealing against and partially extending into a drain opening, the cup permits full thrust of pressurized water into a drainage pipe without a backflow of water. The cup consists of an upper, deformable portion, and a solid, occlusive bottom portion defining a nipple-shaped end. A flow of pressurized water is supplied to the cup through a firm and elongated handle with a lengthwise aperture therethrough. An adjustable valve including a ball component and a regulating lever controls the flow of water into the handle, and thus, to the clogged drain.

For oddly-shaped and rounded drainage openings, the multi-purpose water pressure plunger has a sealing attachment including a compressible cup having a barrel-like bottom and an occlusive semi-spherical disc. When inserted, the barrel-like bottom partially extends into a drainage opening, and when pressed downwardly, the semi-spherical disc seals the barrel-like bottom against walls of a drainage opening, and the perimeter of the compressible cup envelopes round the barrel-like bottom.

DETAILED DESCRIPTION

In accordance with this invention it has been discovered that clogged drainage pipes can be easily and effectively cleared by using a flow of pressurized water. It has also been discovered that a drainage entrance must first be properly sealed to permit full thrust of pressurized water to a clog. It has additionally been found that a cone-shaped cup, comprising a flexible top and a solid bottom portion defining a nipple-shaped end, provides a tight, secure, and complete seal once inserted into the entrance of a drainage pipe. It has further been discovered that all drainage openings are not of the same shape and size, hence a sealing attachment comprising a compressible cup having a barrel-like bottom will fit and seal oddly-shaped and rounded drainage openings. Various other advantages will become apparent from the following description giving with reference to the various figures of drawing.

Figure 1:
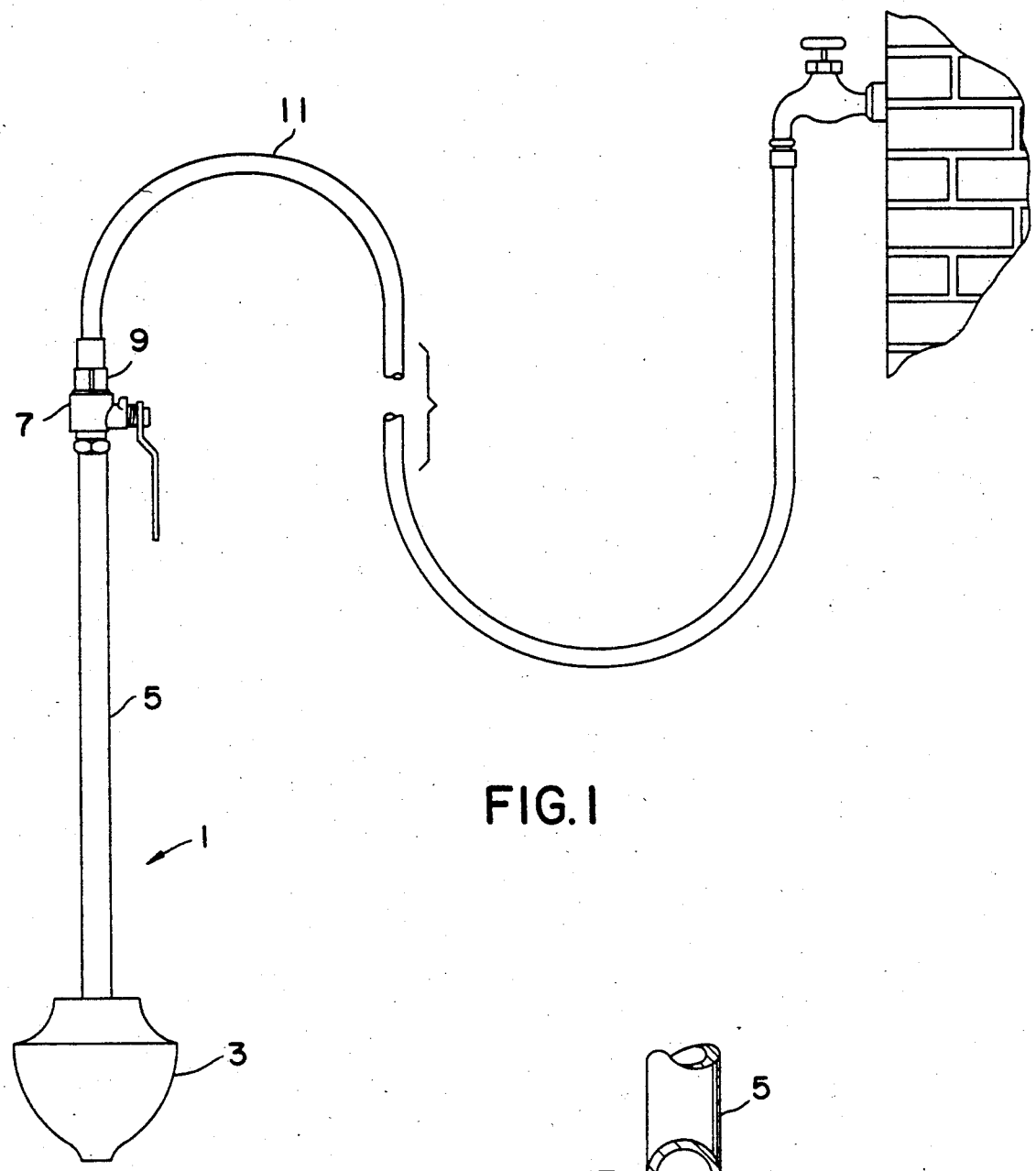
FIG. 1 of the drawings illustrates a perspective view of a multi-purpose water pressure plunger in accordance with the invention.

FIG. 1 of the drawings illustrates a multi-purpose water pressure plunger 1 in accordance with this invention. The plunger illustrated here comprises a cone-shaped member 3, a firm, elongated handle 5, an adjustable valve 7, and a means for connection 9 to a pressurized source of water 11.

Figure 2:
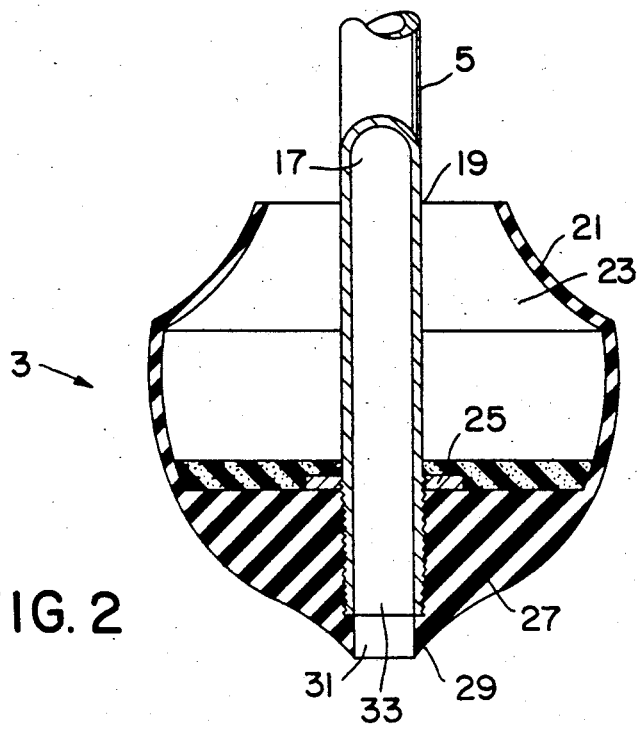
FIG. 2 of the drawings illustrates a cross-sectional view of a cone-shaped member and a firm, elongated handle in accordance with the invention.

FIG. 2 of the drawings illustrates the cone-shaped member 3 which may be of resilient, rubberized material heretofore utilized. It is fashioned with a nipple-shaped end 29 which partially extends into a drain opening. An occlusive bottom portion 27 allows for the secure seal against and inside a drainage entrance. The bottom portion 27 is solid in construction and is of the same rubberized material as the remainder of the cone-shaped member 3. A flexible top portion 21 allows a conformable seal to a drain opening. Through the cone-shaped member 3 runs a central passage 31 beginning at a substantially round opening 19 and terminating in nipple-shaped end 29. A circular pressure disc 25 is embedded in the rubberized material of the solid bottom portion 27 and is engaged upon the firm, elongated handle 5. This association between the firm, elongated handle 5 and the round pressure disc 25 allows leverage for manipulating the solid bottom portion 27 to form a firm drainage seal.

Through a substantially round opening 19, the end of the firm, elongated handle 5 extends into the flexible top portion 21 of the cone-shaped member 3 through central passage 31, the extension terminating in the nipple-shaped end 29. The firm, elongated handle 5 is preferably formed of sturdy, non-corrosive metal, PVC pipe, or the like. A lengthwise aperture 17 runs inside the firm, elongated handle 5 providing a channel through which a flow of pressurized water will travel from its source 11 to the ultimate drainage clog. The firm, elongated handle 5 has an open end 33 which lies in the nipple-shaped end 29. Opposite the open end 33, the firm, elongated handle 5 has a female means for connection 9 to a pressurized source of water 11.

Figure 3:
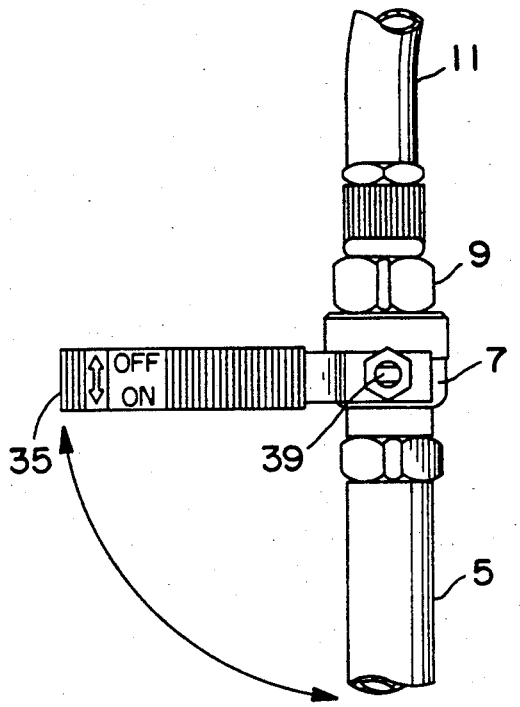
FIG. 3 of the drawings illustrates a sectional view of an adjustable valve in accordance with the invention.

FIG. 3 of the drawings illustrates an adjustable valve 7 positioned on the end of the firm, elongated handle 5 opposite the cone-shaped member 3. The adjustable valve 7 is fashioned from leak-proof and non-corrosive materials which have suitable coatings, platings, and flow characteristics for the intended application. A regulating lever 35 controls a ball component (not shown in the drawings) which in turn governs the flow of water from the pressurized source 11 through the lengthwise aperture 17. The regulating lever 35, attached to the adjustable valve 7 by a screw 39, prohibits a flow of water when it is moved perpendicular to the firm, elongated handle 5. When the regulating lever 35 is moved downward from its "off" position, a flow of water begins. A full thrust of pressurized water is realized when the regulating lever 35 becomes fully parallel to the elongated firm handle 5.

During operation, a pressurized source of water 11 such as a garden hose, or the like, is connected to the female means 9. The regulating lever 35 will remain in the "off" position perpendicular to the firm, elongated handle 5 until the cone-shaped member 3 is properly positioned. When the nipple-shaped end 29 is inserted into a clogged drainage pipe and the solid bottom 27 has securely formed a tight seal against and inside the drainage entrance, the regulating lever 35 is pushed downward allowing the flow of water through the lengthwise aperture 17 inside the firm, elongated handle 5. The flow of water continues through the cone-shaped member 3 and out nipple-shaped end 29 and into the clogged drain. The tight seal of the cone-shaped member 3 will prevent a backflow of water and the regulating lever 35 will permit the appropriate flow of water to the clog. To dislodge a large obstruction, the regulating lever 35 is pushed parallel to the elongated firm handle 5 which will allow a full thrust of pressurized water into the drain, effectively and safely pushing the clog from its lodged position into the sewer system.

The cone-shaped member 3 is designed to fit almost any size drain opening. The flexible top portion 21 can conform to any size opening should the solid bottom portion 27 be unable to secure a tight enough seal.

Figure 4:
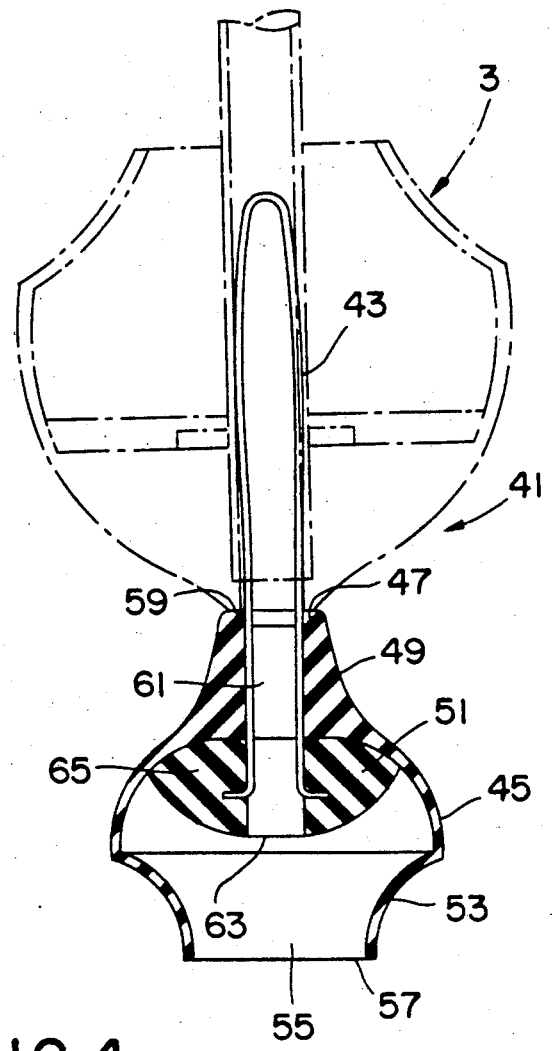
FIG. 4 of the drawings illustrates a cross-sectional view of a sealing attachment in accordance with this invention.

FIG. 4 of the drawings illustrates a sealing attachment 41 comprising a spring wire 43 attached to and extending from a compressible cup 45 consisting of a semi-spherical disc 51 formed of a solid and occlusive rubberized material, an interior cavity 55, and a barrel-like bottom 53. Spring wire 43 is elongated, substantially U-shaped, and consisting of a springy, non-corrosive metal or steel having unattached ends 65 engaged in semi-spherical disc 51 and being elongated and longitudinally extending through a lengthwise interior passage 61 along the perimeter thereof and for several inches opposite a substantially circular opening 59. The upper portion 49 of compressible cup 45 is fashioned of a solid rubberized material with semi-spherical disc 51 fixedly attached thereon inside interior cavity 55 and including circular opening 59 which communicates with lengthwise interior passage 61 beginning at circular opening 59 and extending through upper portion 49 and continuing through semi-spherical disc 51 and terminating thereon at an open end 63. Barrel-like bottom 51 is constructed of a resilient and deformable rubberized material having a circumferential orifice 57.

Sealing attachment 41 comprises compressible cup 45 which is agile and occlusive providing a flexible and secure seal to oddly-shaped and rounded drainage openings. When in operation, sealing attachment 41 is affixed to cone-shaped member 3 by insertion of spring wire 43 through central passage 31 into lengthwise aperture 17 of firm, elongated handle 5. An expansion of spring wire 43 inside lengthwise aperture 17 holds compressible cup 45 firmly in place with additional support provided by nipple-shaped end 29 accordingly fitting into entrance 47 of compressible cup 45 which conforms to the contour thereof. A source of pressurized water 11 is attached to female means 9. The regulating lever 35 will remain in the "off" position perpendicular to the elongated firm handle 5 until compressible cup 45 is placed in proper position. Barrel-like bottom 53 is partially inserted into a drainage opening and a downward pressure is applied to cone-shaped member 3 using firm, elongated handle 5 resulting in the deformation of compressible cup 45 thereby causing semi-spherical disc 51 to extend downwardly into interior cavity 55 sealing barrel-like bottom 53 against walls of a drainage opening. Accordingly, the perimeter of compressible cup 45 envelopes around barrel-like bottom 53 as regulating lever 35 is pushed downward allowing the flow of water through the lengthwise aperture 17 inside firm, elongated handle 5. The flow of water continues through the cone-shaped member 3 via central passage 31 and out nipple-shaped end 29 of cone-shaped member into lengthwise interior passage 61 of compressible cup 45 and finally to the clogged drain. Since the semi-spherical disc is positioned substantially over the drainage opening and buttresses the barrel-like bottom against the walls of a drainage opening, a full thrust of pressurized water can enter the drainage pipe without a backflow of unsanitary water.

The multi-purpose water pressure plunger, in accordance with this invention, exhibits superior qualities not found in the prior art. The cone-shaped cup is both agile and occlusive and provides a flexible and secure seal to almost any size drain opening. The present invention produces a tight seal, especially important in preventing a backflow of unsanitary water and necessary to flush a clog from drainage pipe into a sewer system.

It is thus seen in accordance with this invention a greatly improved water pressure plunger has been provided wherein a resilient, cone-shaped cup, comprising an agile top portion and a solid, occlusive bottom portion defining a nipple-shaped end, provides a secure and complete seal of a drain opening to permit an uninterrupted flow of pressurized water to flush a drainage clog into the sewer system without a backflow of unsanitary water. Additionally, an improved multi-purpose water pressure plunger has been provided including a sealing attachment which seals oddly-shaped or rounded drainage openings. The sealing attachment includes a compressible cup having a barrel-like bottom and an occlusive semi-spherical disc which buttresses the barrel-shaped bottom to walls of a drainage opening.

As various modifications will become apparent to those in the art from a reading of the above description, such modification are within the breadth of this invention as fall within the spirit and scope of the following appended claims.

That which is claimed is:

1. A multi-purpose water pressure plunger which sanitarily, efficiently, and dependably utilizes water pressure to clear clogged bathroom drains and the like, the improvement including a sealing attachment comprising:

a compressible cup having an interior cavity and including an upper portion, fashioned of solid rubberized material, and a barrel-like bottom for partially extending into and sealing against walls of a drainage opening, said barrel-like bottom defining a nipple-shaped end with a circumferential orifice, said upper portion defining an entrance which conforms to the contour of said nipple-shaped end and having an interior passage therethrough beginning in a circular opening adjacent to said entrance, said barrel-like bottom constructed of a substantially deformable rubberized material;

a semi-spherical disc, formed of an occlusive and solid rubberized material, fixedly positioned on said upper portion inside said interior cavity, said semi-spherical disc including said interior passage therethrough, said interior passage terminating at said semi-spherical disc at an open end diametrically positioned thereon, said semi-spherical disc, when pressed downwardly, descends into said interior cavity pushing against the inner surface of said barrel-like bottom therefore causing said barrel-like bottom to buttress against the walls of a drainage opening;

a spring wire for attachment of said compressible cup to said cone-shaped member, a spring wire consisting of a U-shaped, springy and non-corrosive metal or steel which, when inserted into said lengthwise aperture via said central passage, expands thus firmly holding said compressible cup in place, said spring wire having unattached ends engaged in said semi-spherical disc and being elongated and longitudinally extending through said interior passage along the perimeter thereof and for several inches opposite said circular opening.

2. A multi-purpose water pressure plunger according to claim 1 wherein said cone-shaped member roughly defines a V-shape.

3. A multi-purpose water pressure plunger according to claim 2 wherein said cone-shaped member is of such a contour so as to allow for the sealing of drain openings.

4. A multi-purpose water pressure plunger according to claim 1 wherein said solid bottom contains a round inner pressure disc on which said handle element is engaged, said pressure disc allowing leverage for applying force upon said cone-shaped member so as to form a tight drainage seal.

5. A multi-purpose water pressure plunger according to claim 1 wherein the length approaches twenty-six inches, giving the user a conveniently operable length with which to perform the intended operation.

6. A multi-purpose water pressure plunger according to claim 1 wherein said means on said handle element for the connection to a pressurized source of water is of standard, threaded design and compatible with any standard, threaded source of pressurized water.

* * * * *